US006989080B2

(12) United States Patent
Hansen

(10) Patent No.: US 6,989,080 B2
(45) Date of Patent: Jan. 24, 2006

(54) NONWOVEN NEUTRAL LINE DRYER FABRIC

(75) Inventor: Robert A. Hansen, Stuttgart-Birkach (DE)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 10/465,168

(22) Filed: Jun. 19, 2003

(65) Prior Publication Data

US 2004/0259450 A1 Dec. 23, 2004

(51) Int. Cl.
*D21F 7/12* (2006.01)

(52) U.S. Cl. ..... 162/375; 162/361; 162/902; 34/116; 428/112; 428/114; 428/119; 428/167; 428/172; 442/337; 442/338; 442/352; 442/389; 442/392; 442/269

(58) Field of Classification Search ..... 139/383 A, 139/383 AA, 425 A; 162/204–207, 306, 162/348, 358.2, 358.4, 116, 117, 900–904; 34/114–123; 428/105, 107, 109, 112, 114, 428/119, 156, 163, 167, 172; 442/335–338, 442/352, 359, 381, 389, 392, 268, 269
See application file for complete search history.

(56) References Cited

U.S. PATENT DOCUMENTS

| | | | | |
|---|---|---|---|---|
| 3,097,413 | A * | 7/1963 | Draper Jr. | 34/95 |
| 5,118,391 | A * | 6/1992 | Matuschczyk et al. | 162/358.4 |
| 5,169,499 | A | 12/1992 | Eagles et al. | |
| 5,202,170 | A * | 4/1993 | Hsu et al. | 428/48 |
| 5,268,076 | A | 12/1993 | Best et al. | |
| 5,360,656 | A * | 11/1994 | Rexfelt et al. | 428/193 |
| 5,766,421 | A * | 6/1998 | Aufrecht | 162/358.4 |
| 5,785,818 | A * | 7/1998 | Fekete et al. | 162/358.2 |
| 5,864,931 | A | 2/1999 | Best et al. | |
| 5,939,176 | A | 8/1999 | Yook | |
| 6,231,928 | B1 | 5/2001 | McGahern | |
| 6,265,048 | B1 * | 7/2001 | Rydin et al. | 428/121 |
| 6,283,165 | B1 * | 9/2001 | Best | 139/383 A |
| 6,284,102 | B1 * | 9/2001 | Inoue et al. | 162/358.4 |
| 6,350,336 | B1 * | 2/2002 | Paquin | 156/93 |
| 6,660,362 | B1 * | 12/2003 | Lindsay et al. | 428/131 |
| 2004/0118545 | A1 * | 6/2004 | Bakken et al. | 162/348 |

FOREIGN PATENT DOCUMENTS

| | | |
|---|---|---|
| CA | 2 422 363 | 10/2003 |
| EP | 1 045 066 | 10/2000 |
| EP | 1 067 238 | 1/2001 |
| EP | 1 357 223 | 10/2003 |
| EP | 1 359 251 | 11/2003 |
| EP | 1 359 252 | 11/2003 |
| WO | WO 02/29157 | 4/2002 |

* cited by examiner

*Primary Examiner*—Eric Hug
(74) *Attorney, Agent, or Firm*—Frommer Lawrence & Haug LLP; Ronald R. Santucci

(57) ABSTRACT

A nonwoven papermaker's fabric, usable in the dryer section of a paper machine, has a spiral wound machine direction (MD) base layer of raw stock which is wound around a pair of parallel rolls or cylinders until the desired length and width is achieved. The spiral wound MD layer is overlaid with a cross-machine direction (CD) layer of similar or dissimilar raw stock and mated by any of a number of means. The spiral wound MD layer can also be mated to another MD layer spiraled in the opposite direction and in one embodiment further mated to a CD layer. The fabric is preferably produced so that its neutral line is oriented toward the paper side of the fabric so that the paper sheet will stretch less than when typical dryer fabrics are used to turn the paper sheet and fabric around the dryer cylinders.

32 Claims, 3 Drawing Sheets

NONWOVEN NEUTRAL LINE DRYER FABRIC

BACKGROUND OF THE INVENTION

1. Field of the Invention

The present invention relates to the papermaking arts. More specifically, the present invention relates to dryer fabrics for the dryer section of a paper machine.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates specifically to the dryer fabrics used in the dryer section. The cylinders in a dryer section may be arranged in a top and a bottom row or tier. Those in the bottom tier may be staggered relative to those in the top tier, rather than being in a strict vertical relationship. As the sheet proceeds through the dryer section, it may pass alternately between the top and bottom tiers as it passes first around a dryer cylinder in one of the two tiers, then around a dryer cylinder in the other tier, and so on sequentially through the dryer section.

In order to increase production rates and to minimize disturbance to the sheet, single-run dryer sections may be used to transport the sheet being dried at high speeds. In a single-run dryer section, such as that shown in FIG. 5, a paper sheet 198 is transported by use of a single dryer fabric 199 which follows a serpentine path sequentially about dryer cylinders 200 in the top and bottom tiers. Additionally, a number of turning rolls may be used. These turning rolls may be solid or vented.

It will be appreciated that, in a single-run dryer section, the dryer fabric holds the paper sheet being dried directly against the dryer cylinders in one of the two tiers, typically the top tier, but carries it around the dryer cylinders in the bottom tier. The fabric return run is above the top dryer cylinders. On the other hand, some single-run dryer sections have the opposite configuration in which the dryer fabric holds the paper sheet directly against the dryer cylinders in the bottom tier, but carries it around the top cylinders. In this case, the fabric return run is below the bottom tier of cylinders. In either case, a compression wedge is formed by air carried along by the backside surface of the moving dryer fabric in the narrowing space where the moving dryer fabric approaches a dryer cylinder. The resulting increase in air pressure in the compression wedge causes air to flow outwardly through the dryer fabric. This air flow, in turn, forces the paper sheet away from the surface of the dryer fabric, a phenomenon known as "drop off". Drop off can reduce the quality of the paper product being manufactured by causing edge cracks. Drop off can also reduce machine efficiency if it leads to sheet breaks.

Many paper mills have addressed this problem by machining grooves into the dryer rolls or by adding a vacuum source to the dryer rolls. Both of these expedients allow the air otherwise trapped in the compression wedge to be removed without passing through the dryer fabric, although both approaches are expensive.

Contemporary dryer fabrics are produced in a wide variety of styles designed to meet the requirements of the paper machines on which they are installed for the paper grades being manufactured. Generally, they comprise a base fabric usually woven from monofilaments and may be single-layered or multi-layered. The yarns are typically extruded from any one of several synthetic polymeric resins, such as polyamide and polyester resins, used for this purpose by those of ordinary skill in the paper machine clothing arts.

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. While many fabrics are endless, many of those used today are on-machine-seamable. Installation of the fabric includes pulling the fabric body onto a machine and joining the fabric ends to form an endless belt.

In response to this need to produce fabrics in a variety of lengths and widths more quickly and efficiently, fabrics have been produced in recent years using a spiral winding technique disclosed in commonly assigned U.S. Pat. No. 5,360,656 to Rexfelt et al., the teachings of which are incorporated herein by reference.

U.S. Pat. No. 5,360,656 shows a fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the spirally continuous seam so produced may be closed by sewing, stitching, melting, welding (e.g. ultrasonic) or gluing. Alternatively, adjacent longitudinal edge portions of adjoining spiral turns may be arranged overlappingly, so long as the edges have a reduced thickness, so as not to give rise to an increased thickness in the area of the overlap. Alternatively still, the spacing between lengthwise yarns may be increased at the edges of the strip, so that, when adjoining spiral turns are arranged overlappingly, there may be an unchanged spacing between lengthwise threads in the area of the overlap.

In any case, a woven base fabric, taking the form of an endless loop and having an inner surface, a longitudinal (machine) direction and a transverse (cross-machine) direction, is the result. The lateral edges of the woven base fabric are then trimmed to render them parallel to its longitudinal (machine) direction. The angle between the machine direction of the woven base fabric and the spirally continuous seam may be relatively small, that is, typically less than 10°. By the same token, the lengthwise (warp) yarns of the woven fabric strip make the same relatively small angle with the longitudinal (machine) direction of the woven base fabric. Similarly, the crosswise (filling) yarns of the woven fabric strip, being perpendicular to the lengthwise (warp) yarns, make the same relatively small angle with the transverse (cross-machine) direction of the woven base fabric. In short, neither the lengthwise (warp) nor the crosswise (filling) yarns of the woven fabric strip align with the longitudinal (machine) or transverse (cross-machine) directions of the woven base fabric.

A fabric having such a base fabric may be referred to as a multiaxial fabric. Whereas the standard fabrics of the prior art have three axes: one in the machine direction (MD), one in the cross-machine direction (CD), and one in the z-direction, which is through the thickness of the fabric, a multiaxial fabric has not only these three axes, but also has at least two more axes defined by the directions of the yarn systems in its spirally wound layer or layers. Moreover, there are multiple flow paths in the z-direction of a multiaxial fabric. As a consequence, a multiaxial fabric has at least five axes. Because of its multiaxial structure, a multiaxial fabric having more than one layer exhibits superior resistance to nesting and/or to collapse in response to compression during the papermaking process as compared to one having base fabric layers whose yarn systems are parallel to one another.

The present invention provides an alternative to typical woven dryer fabrics. The present invention is a non-woven dryer fabric produced directly from raw material stock. This approach allows for the incorporation of bulk material elements in the fabric and for greater design control of the operating characteristics of the fabric. Moreover, the present fabric may be produced using a spiral winding technique, similar to that discussed above, only replacing the strips of woven material with raw stock material elements.

SUMMARY OF THE INVENTION

Accordingly, the present invention is a dryer fabric, although it may find application in the forming, pressing and drying sections of a paper machine.

The present invention is a nonwoven papermaker's fabric for use in a dryer section of a papermaking machine. The fabric has a spiral wound machine direction (MD) layer made of a first raw stock material. The spiral wound MD layer is formed by winding MD elements of the first raw stock material around a pair of parallel rolls or cylinders until the layer has a desired length and a desired width. A cross-machine direction (CD) layer of CD elements of a second raw stock material is overlaid and mated with the spiral wound MD layer. Preferably this is done so that the fabric has a neutral line oriented towards a paper side of the fabric. This neutral line placement in the z-direction or thickness direction in the fabric reduces stretching of the supported paper sheet when used in a papermaking machine as the fabric turns around the cylinders in the papermaking machine.

In another embodiment of the invention, the fabric has a first spiral wound machine direction (MD) layer of a first raw stock material. The first spiral wound MD layer is formed by winding MD elements of the first raw stock material in a first direction around a pair of parallel rolls or cylinders until the layer has a desired length and a desired width. A second spiral wound MD layer of a second raw stock material is formed by winding MD elements of the second raw stock material in a second direction, opposite to the first direction. The second spiral wound MD layer is overlaid and mated with the first spiral wound MD layer. Preferably this is done so that the fabric has a neutral line oriented towards a paper side of the fabric. This, as above, also reduces stretching of the paper sheet when used in a papermaking machine as the fabric turns around the cylinders in the papermaking machine.

In a further embodiment, in addition to the first and second spiral wound MD layers (or more) a CD layer is provided and overlaid (or sandwiched therebetween) the MD layers and mated therewith.

Other aspects of the present invention include that the spiral wound MD layer forms the paper side of the fabric and the CD layer forms a machine side of the fabric. The first raw stock material may be the same as the second raw stock material. The MD elements and the CD elements are preferably flat filaments, round filaments, textured filaments, bulk-crimped filaments, shaped filaments, hollow filaments, films, nonwoven materials, or segments of woven material. The raw stock material is preferably one of polyamide, polyester, polyolefins, or other polymeric material. The air permeability and water permeability of the fabric are determined by the spacing of the MD elements. The CD elements may be mated to the spiral wound MD layer using a rotating cylinder having spacing elements to place the CD elements directly onto the spiral wound MD layer. The CD layer may alternately be mated to the spiral wound MD layer using a heat activated bonding process.

The CD elements may be provided with MD oriented channels or grooves to provide for enhanced air handling by the fabric. The CD elements may also be wound.

The present invention will now be described in more complete detail with frequent reference being made to the drawing figures, which are identified below.

BRIEF DESCRIPTION OF THE DRAWINGS

For a more complete understanding of the invention, reference is made to the following description and accompanying drawing, in which.

DETAILED DESCRIPTION OF THE PREFERRED EMBODIMENTS

The present invention relates to a fabric produced for the dryer section of a paper machine that is produced as a nonwoven product using various different raw stock materials. The present fabric is an alternative to typical dryer fabrics which are woven using polymeric monofilament or multifilament yarns or spiral-link dryer fabrics.

Figure 1:
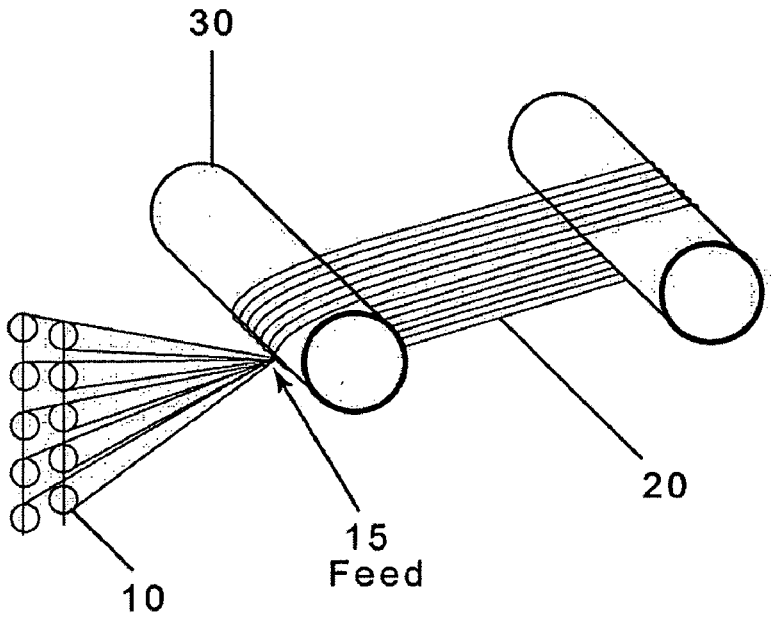
FIG. 1 is a setup for producing the spiral wound base layer of raw stock in accordance with the teachings of the present invention.

Specifically, the present fabric has a spiral wound machine direction (MD) base layer of raw stock which is wound around two parallel cylinders until the desired length and width is achieved. This spiral winding technique is similar to that taught in the '656 patent—which is discussed above and is incorporated herein by reference—only the strips of woven material are replaced in the present invention with raw stock material elements. FIG. 1 is an exemplary setup for producing the spiral wound base layer of raw stock elements in accordance with the teachings of the present invention. As shown in FIG. 1, the raw stock material is fed via a delivery system, preferably from a harness/spool arrangement 10, through a feed mechanism 15 which winds the stock around the cylinders 30 (heated or unheated) to form a spiral wound base layer 20 until the desired length and width is achieved. This base layer is essentially a spiral wound layer of raw stock material that is fundamentally length oriented. The spacing between elements of the raw stock material can be zero to form a sealed cylinder, or may be appropriately spaced to control the air and water permeability of the fabric. It is to be understood that many other setups can be used to produce the spiral wound base layer and that the present invention is not to be limited to this setup.

Figure 3:
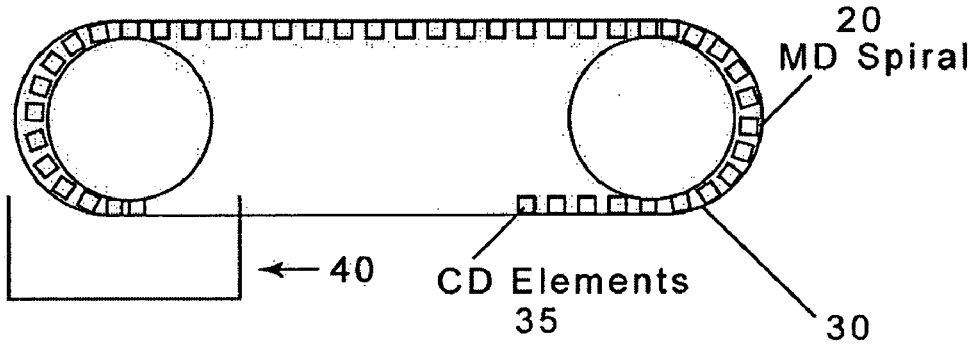
FIG. 3 is a setup for mating the CD layer of raw stock to the spiral wound base layer in accordance with the teachings of the present invention.

This spiral wound MD layer is overlaid with a cross-machine direction (CD) layer of similar or dissimilar raw stock and mated by any of a number of means. FIG. 3 is an exemplary setup for mating the CD layer of raw stock to the spiral wound base layer in accordance with the teachings of the present invention. As shown in FIG. 3, the spiral wound layer 20 is rotated about two cylinders 30 and elements of the CD raw stock material 35 are attached to the MD layer by a feed mechanism 40.

Figure 4:
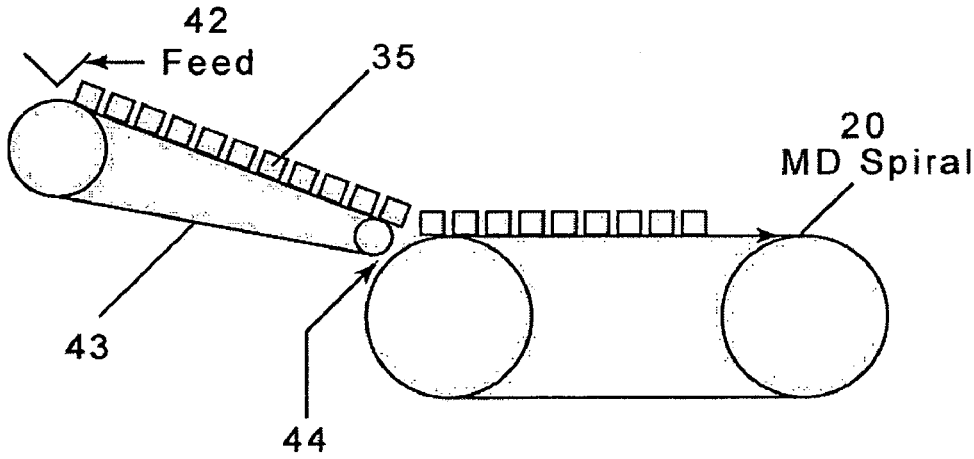
FIG. 4 is another setup for mating the CD layer of raw stock to the spiral wound base layer in accordance with the teachings of the present invention.
Figure 5:
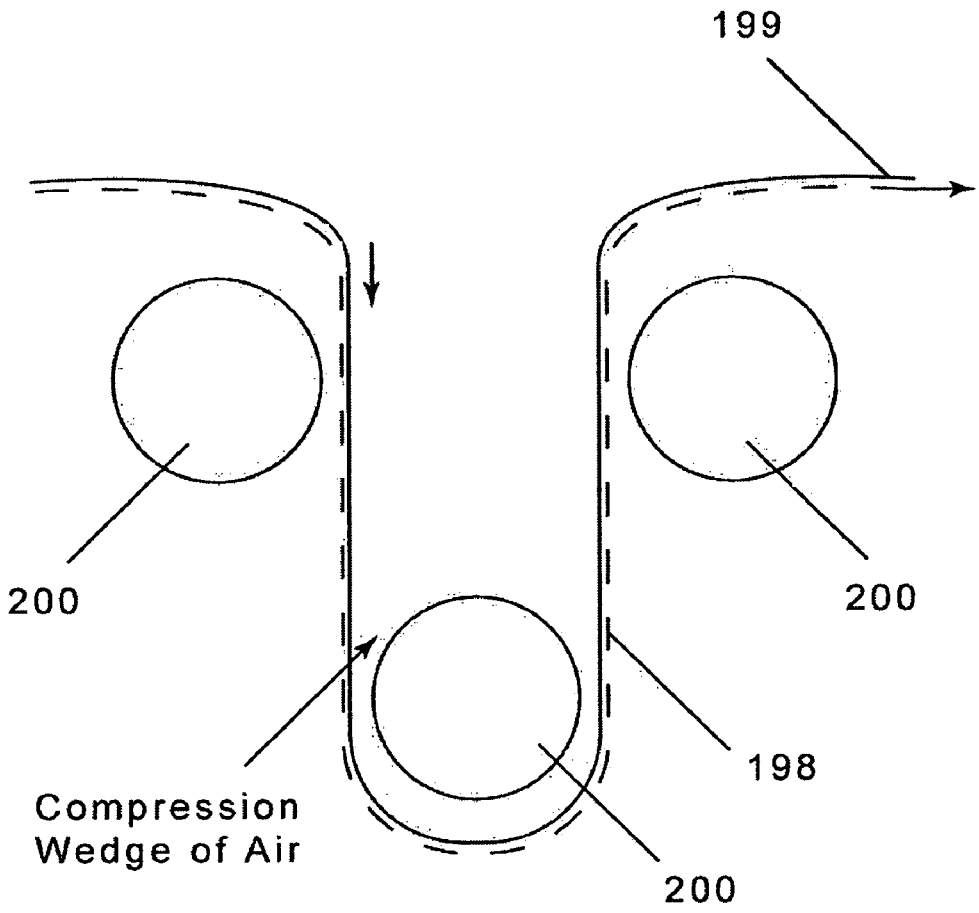
FIG. 5 is a cross-sectional view of a single-run dryer section.

FIG. 4 is another exemplary setup for mating the CD layer of raw stock to the MD base layer in accordance with the teachings of the present invention. As shown in FIG. 4, the spiral wound layer 20 is rotated about two cylinders and elements of the CD raw stock material 35 are fed by a feed mechanism 42 through a conveyor means 43 and attached to the MD layer by an attachment means 44. In this embodiment, the fabric may be turned inside out so that the MD layer is the paper side of the fabric and the CD layer is the machine (or wear) side of the fabric.

The CD elements can be overlaid onto the spiral wound MD layer by a variety of methods, including a rotating cylinder with spacing elements or forms that allow a rotating cylinder to feed the elements directly to the MD spiral.

Each MD winding of raw stock is mated to the adjacent winding by any of a variety of means, including adhesion via glues (hot melts, male/female 'snaps', applying a binder system to mate the elements (via sewing, knitting, etc . . . ), or by applying a layer of meltable, fusible material between the windings and applying heat to the structure to subsequently bond the windings together.

Similarly, the MD spiral of raw stock is mated to the perpendicular attached CD elements of similar or dissimilar raw stock by any of a variety of means, including adhesion via glues (hot melts, male/female 'snaps' (where practical), applying a binder system to mate the CD and MD elements (via sewing, knitting, etc . . . ), or by applying a layer of meltable, fusible material between the CD and MD layers and applying heat to the structure to subsequently bond the layers together. This bonded structure forms a nonwoven fabric consisting of MD elements and CD elements which provide the stability and integrity necessary for a papermaking fabric.

Alternatively, in another embodiment of the present invention, the original spiral wound MD layer can be mated to another spiral wound MD layer that is wound in the opposite direction in order to provide the necessary stability in the MD and the CD. Note this process can be extended so that as many spiral wound layers could be laminated together in a manner as aforementioned as required to form the fabric.

A variation on this would be to include a CD layer in addition to the two (or more) MD layers which may be laid on or sandwiched therebetween with all the layers appropriately laminated together.

Figure 2A:
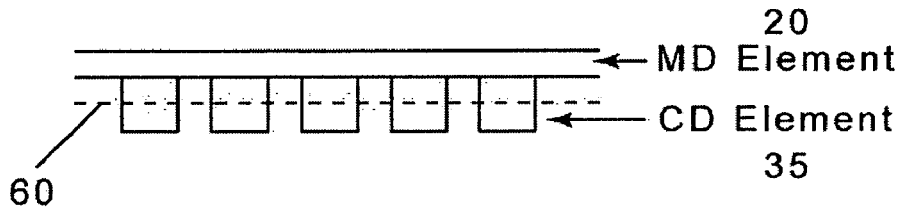
FIG. 2A shows a straightened view of the present fabric in FIG. 2.
Figure 2:
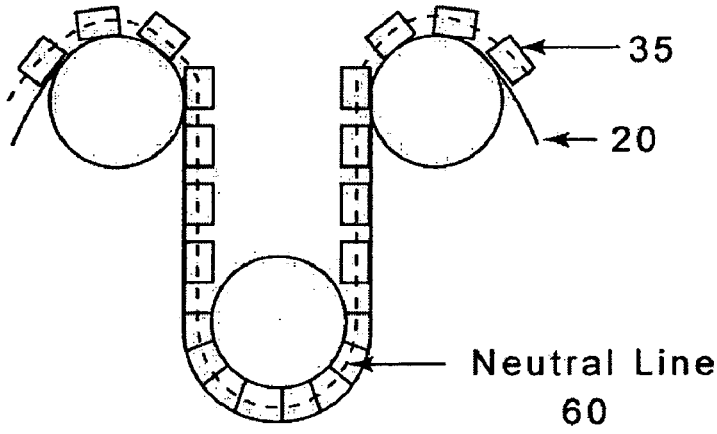
FIG. 2 shows a nonwoven fabric according to the present invention installed on a dryer section of a papermaking machine.

The present fabric can be preferably produced so that its neutral line is oriented (i.e. offset or biased) towards the paper side of the fabric so that the paper sheet will stretch less than when typical dryer fabrics are used as the sheet and fabric pass around the dryer cylinders. FIG. 2 shows a nonwoven fabric according to the present invention installed on a dryer section of a papermaking machine. FIG. 2A shows a straightened view of the present fabric in FIG. 2, which is comprised of the spiral wound MD layer 20 and the CD layer 35 having a neutral line 60 that is offset towards one side of the fabric as shown (by the dashed line).

One method to produce such an offset neutral line is by applying a CD layer that is as thick or thicker in caliper than the MD layer. This provides a structure that exhibits this flexed behavior when wrapped around the dryer cylinders, thereby providing a greater change in distance in the MD on one side of the fabric as opposed to the other side of the fabric. This is advantageous for production of the paper sheet, since when the paper is in contact with the fabric side closer to the neutral line, the fabric and therefore the paper will be stretched less than with typical fabrics as the fabric turns around the dryer cylinders.

The present fabric can either be produced endless or preferably be joined together via a seam, employing any method known in the art.

The raw stock materials used in the present invention are preferably polyesters, polyolefins (polypropylene), polyphenylene sulfide (PPS, which is commercially available under the name RYTON®), polyamides, or other polymer materials. Another example material is a modified heat-, hydrolysis- and contaminant-resistant polyester of the variety disclosed in commonly assigned U.S. Pat. No. 5,169,499, and used in dryer fabrics sold by Albany International Corp. under the trademark THERMONETICS®. The teachings of U.S. Pat. No. 5,169,499 are incorporated herein by reference. Further, such materials as poly (cyclohexanedimethylene terephthalate-isophthalate) (PCTA), polyetheretherketone (PEEK) and others could also be used. Any combination of materials may be used as identified by one of ordinary skill in the art.

The process according to the present invention involves the use of raw stock elements, which could be flat filaments, round filaments, textured filaments, bulk-crimped filaments, shaped filaments (tongue-in-groove, tetrahedral, elliptical, rectangular, etc . . . ), hollow filaments, films (perforated or nonperforated), nonwoven materials (i.e. spun bond, melt bond, etc . . . ), or segments of woven material. Note that flat filaments can be utilized in both the MD and CD sections, or as in the case of opposing spiral wound layers, in one or all of the spiral wound layers. Any combination of elements for either layer of the fabric may be used as identified by one of ordinary skill in the art.

Note that some or all of the CD elements could include MD oriented channels or grooves to enhance air handling by the fabric. Note also that some or all of the CD elements could be wound.

Modifications to the above would be obvious to those of ordinary skill in the art, but would not bring the invention so modified beyond the scope of the present invention. The claims to follow should be construed to cover such situations.

What is claimed is:

1. A nonwoven papermaker's fabric comprising:

a spiral wound machine direction (MD) layer of a first raw stock material having a desired length and a desired width; and a cross-machine direction (CD) layer of CD elements of a second raw stock material overlaid and mated with the spiral wound MD layer, wherein the fabric has a neutral line oriented towards a paper side of the fabric, thereby reducing stretching of a paper sheet when installed in a papermaking machine as the fabric turns around cylinders in the papermaking machine.

2. The papermaker's fabric according to claim 1, wherein the spiral wound MD layer is formed by winding MD elements of the first raw stock material around a pair of parallel cylinders.

3. The papermaker's fabric according to claim 1, wherein the spiral wound MD layer forms the paper side of the fabric and the CD layer forms a machine side of the fabric.

4. The papermaker's fabric according to claim 1, wherein the first raw stock material is the same as the second raw stock material.

5. The papermaker's fabric according to claim 1, wherein the fabric is a dryer fabric for use in a dryer section of the papermaking machine.

6. The papermaker's fabric according to claim 1, wherein some or all of the MD elements are flat filaments, round filaments, textured filaments, bulk-crimped filaments, shaped filaments, hollow filaments, films, nonwoven materials, or segments of woven material.

7. The papermaker's fabric according to claim 1, wherein some or all of the CD elements are flat filaments, round filaments, textured filaments, bulk-crimped filaments, shaped filaments, hollow filaments, films, nonwoven materials, or segments of woven material.

8. The papermaker's fabric according to claim 7, wherein some or all of said CD elements have MD oriented channels or grooves.

9. The papermaker's fabric according to claim 1, wherein the first raw stock material is one of polyamide, polyester, polyolefins, or other polymeric material.

10. The papermaker's fabric according to claim 1, wherein the second raw stock material is one of polyamide, polyester, polyolefins, or other polymeric material.

11. The papermaker's fabric according to claim 1, wherein the CD elements are mated to the spiral wound MD layer using a rotating cylinder having spacing elements to place the CD elements directly onto the spiral wound MD layer.

12. The papermaker's fabric according to claim 1, wherein the CD layer is mated to the spiral wound MD layer using a heat activated bonding process.

13. A nonwoven papermaker's fabric comprising:

a first spiral wound machine direction (MD) layer of a first raw stock material; the first spiral wound MD layer being formed by winding MD elements of the first raw stock material in a first direction around a pair of parallel cylinders until the layer has a desired length and a desired width; and a second spiral wound MD layer of a second raw stock material formed by winding MD elements of the second raw stock material in a second direction, opposite the first direction;

the second spiral wound MD layer being overlaid and mated with the first spiral wound MD layer, wherein the fabric has a neutral line oriented towards a paper side of the fabric, thereby reducing stretching of the fabric when installed in a papermaking machine as the fabric turns around cylinders in the papermaking machine.

14. The papermaker's fabric according to claim 13, wherein the first spiral wound MD layer forms the paper side of the fabric and the second MD layer forms a machine side of the fabric.

15. The papermaker's fabric according to claim 13, wherein the first raw stock material is the same as the second raw stock material.

16. The papermaker's fabric according to claim 13, wherein the fabric is a dryer fabric for use in a dryer section of the papermaking machine.

17. The papermaker's fabric according to claim 13, wherein some or all of the MD elements are of flat filaments, round filaments, textured filaments, bulk-crimped filaments, shaped filaments, hollow filaments, films, nonwoven materials, or segments of woven material.

18. The papermaker's fabric according to claim 13, wherein the first raw stock material is one of polyamide, polyester, polyolefins, or other polymeric material.

19. The papermaker's fabric according to claim 13, wherein the second raw stock material is one of polyamide, polyester, polyolefins, or other polymeric material.

20. The papermaker's fabric according to claim 14, wherein the second spiral wound MD layer is mated to the first spiral wound MD layer using a heat activated bonding process.

21. A nonwoven papermaker's fabric comprising:

a first spiral wound machine direction (MD) layer of a first raw stock material; the first spiral wound MD layer being formed by winding MD elements of the first raw stock material in a first direction around a pair of parallel cylinders until the layer has a desired length and a desired width;

a second spiral wound MD layer of a second raw stock material formed by winding MD elements of the second raw stock material in a second direction, opposite the first direction;

a cross-machine direction (CD) layer being formed by winding CD elements of a third raw stock material; and said layers being laminated together.

22. The papermaker's fabric according to claim 21 wherein said CD layer is overlaid or sandwiched between said spiral wound MD layers.

23. The papermaker's fabric according to claim 21, wherein the fabric has a neutral line oriented towards a paper side of the fabric, thereby reducing stretching of the fabric when installed in a papermaking machine as the fabric turns around cylinders in the papermaking machine.

24. The papermaker's fabric according to claim 21, wherein the spiral wound MD layers form the paper side of the fabric and the CD layer forms a machine side of the fabric.

25. The papermaker's fabric according to claim 21, wherein the first raw stock material is the same as the second raw stock material.

26. The papermaker's fabric according to claim 25, wherein the third raw stock material is the same as the first raw stock material or the second raw stock material or both.

27. The papermaker's fabric according to claim 21, wherein the fabric is a dryer fabric for use in a dryer section of the papermaking machine.

28. The papermaker's fabric according to claim 23, wherein some or all of the MD elements are flat filaments, round filaments, textured filaments, bulk-crimped filaments, shaped filaments, hollow filaments, films, nonwoven materials, or segments of woven material.

29. The papermaker's fabric according to claim 21, wherein the raw stock material is one of polyamide, polyester, polyolefins, or other polymeric material.

30. The papermaker's fabric according to claim 24, wherein some or all of the CD elements are flat filaments, round filaments, textured filaments, bulk-crimped filaments, shaped filaments, hollow filaments, films, nonwoven materials, or segments of woven material.

31. The papermaker's fabric according to claim 30, wherein some or all of the CD elements have MD oriented channels or grooves.

32. The papermaker's fabric according to claim 21, wherein the wound MD and CD layers are laminated using a heat activated bonding process.

* * * * *

UNITED STATES PATENT AND TRADEMARK OFFICE

CERTIFICATE OF CORRECTION

PATENT NO. : 6,989,080 B2
APPLICATION NO. : 10/465168
DATED : January 24, 2006
INVENTOR(S) : Robert A. Hansen It is certified that error appears in the above-identified patent and that said Letters Patent is hereby corrected as shown below:

Claim 13, beginning at Column 8, line 12 and continuing through Column 8, line 28 should be rewritten as follows:

13. A nonwoven papermaker's fabric comprising:

a first spiral wound machine direction (MD) layer of a first raw stock material; the first spiral wound MD layer being formed by winding MD elements of the first raw stock material in a first direction around a pair of parallel cylinders until the layer has a desired length and a desired width; and a second spiral wound MD layer of a second raw stock material formed by winding MD elements of the second raw stock material in a second direction, opposite the first direction;

the second spiral wound MD layer being overlaid and mated with the first spiral wound MD layer, wherein the fabric has a neutral line oriented towards a paper side of the fabric, thereby reducing stretching of the fabric a paper sheet when installed in a papermaking machine as the fabric turns around cylinders in the papermaking machine.

Claim 23, beginning at Column 9, line 4 and continuing through Column 9, line 8 should be rewritten as follows:

23. The papermaker's fabric according to claim 21, wherein the fabric has a neutral line oriented towards a paper side of the fabric, thereby reducing stretching of the fabric a paper sheet when installed in a papermaking machine as the fabric turns around cylinders in the papermaking machine.

Signed and Sealed this

Twenty-eighth Day of July, 2009

John Doll

JOHN DOLL
*Acting Director of the United States Patent and Trademark Office*